US011772384B2

(12) United States Patent
Hiraga

(10) Patent No.: US 11,772,384 B2
(45) Date of Patent: Oct. 3, 2023

(54) LIQUID DISCHARGE APPARATUS

(71) Applicant: Takumi Hiraga, Kanagawa (JP)

(72) Inventor: Takumi Hiraga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 17/456,913

(22) Filed: Nov. 30, 2021

(65) Prior Publication Data

US 2022/0184967 A1 Jun. 16, 2022

(30) Foreign Application Priority Data

Dec. 15, 2020 (JP) ..... 2020-207289
Nov. 1, 2021 (JP) ..... 2021-178728

(51) Int. Cl.
*B41J 2/175* (2006.01)
*B41J 2/14* (2006.01)
*B41J 2/045* (2006.01)

(52) U.S. Cl.
CPC ..... *B41J 2/17596* (2013.01); *B41J 2/04581* (2013.01); *B41J 2/14201* (2013.01); *B41J 2202/05* (2013.01)

(58) Field of Classification Search
CPC .... B41J 2/04573; B41J 2/175; B41J 2/04541; B41J 2/14201; B41J 2/18; B41J 2/04581; B41J 2/0459; B41J 2202/12; B41J 2202/05
See application file for complete search history.

(56) References Cited

U.S. PATENT DOCUMENTS 10,384,227 B2 * 8/2019 Sakai ..... B41J 2/04588
11,110,718 B2 * 9/2021 Nakamura ..... B41J 2/14201
11,247,464 B2 * 2/2022 Kaiba ..... B41J 3/4073
2020/0039217 A1 2/2020 Kaiba et al.

FOREIGN PATENT DOCUMENTS

JP 63-268655 11/1988
JP 2002-361151 12/2002
JP 2007-030230 2/2007
JP 2010-241003 10/2010
JP 2020-023177 2/2020

* cited by examiner

*Primary Examiner* — An H Do
(74) *Attorney, Agent, or Firm* — IPUSA, PLLC

(57) ABSTRACT

A liquid discharge apparatus includes a liquid discharge head configured to discharge a liquid and a circuitry configured to drive the liquid discharge head. The liquid discharge head includes multiple nozzles from each of which the liquid is dischargeable, multiple valves configured to openably close the multiple nozzles, respectively, and multiple drivers configured to respectively drive the multiple valves, and the circuitry controls a voltage to be applied to the multiple drivers according to a number of driven valves of the multiple valves to be simultaneously driven.

10 Claims, 13 Drawing Sheets

| SET VALUE OF AIR PRESSURE (P) | NUMBER OF NOZZLES SIMULTANEOUSLY DRIVEN(N) | CORRECTION AMOUNT OF APPLICATION VOLTAGE (ΔVh) |
|---|---|---|
| 0.3 MPa | 1 | A1 |
| | 2 | B1 |
| | 3 | C1 |
| | 4 | D1 |
| | 5 | E1 |
| | 6 | F1 |
| | 7 | G1 |
| | 8 | H1 |
| 0.45 MPa | 1 | A2 |
| | 2 | B2 |
| | 3 | C2 |
| | 4 | D2 |
| | 5 | E2 |
| | 6 | F2 |
| | 7 | G2 |
| | 8 | H2 |

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2020-207289, filed on Dec. 15, 2020, in the Japan Patent Office, and Japanese Patent Application No. 2021-178728, filed on Nov. 1, 2021, in the Japan Patent Office, the entire disclosure of which are hereby incorporated by reference herein.

BACKGROUND

Technical Field

Aspects of the present disclosure relate to a liquid discharge apparatus.

Related Art

A liquid discharge head supplies a discharged liquid with a pressure to a cavity communicating with a nozzle. The liquid discharge head includes a pin closable the nozzle. The pin is separatable from and contactable with the nozzle by an actuator. This actuator is controlled by a controller so that the discharge liquid supplied with a pressure is discharged from the nozzle as liquid droplets only while the pin is separated from the nozzle.

SUMMARY

A liquid discharge apparatus includes a liquid discharge head configured to discharge a liquid and a circuitry configured to drive the liquid discharge head. The liquid discharge head includes multiple nozzles from each of which the liquid is dischargeable, multiple valves configured to openably close the multiple nozzles, respectively, and multiple drivers configured to respectively drive the multiple valves, and the circuitry controls a voltage to be applied to the multiple drivers according to a number of driven valves of the multiple valves to be simultaneously driven.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
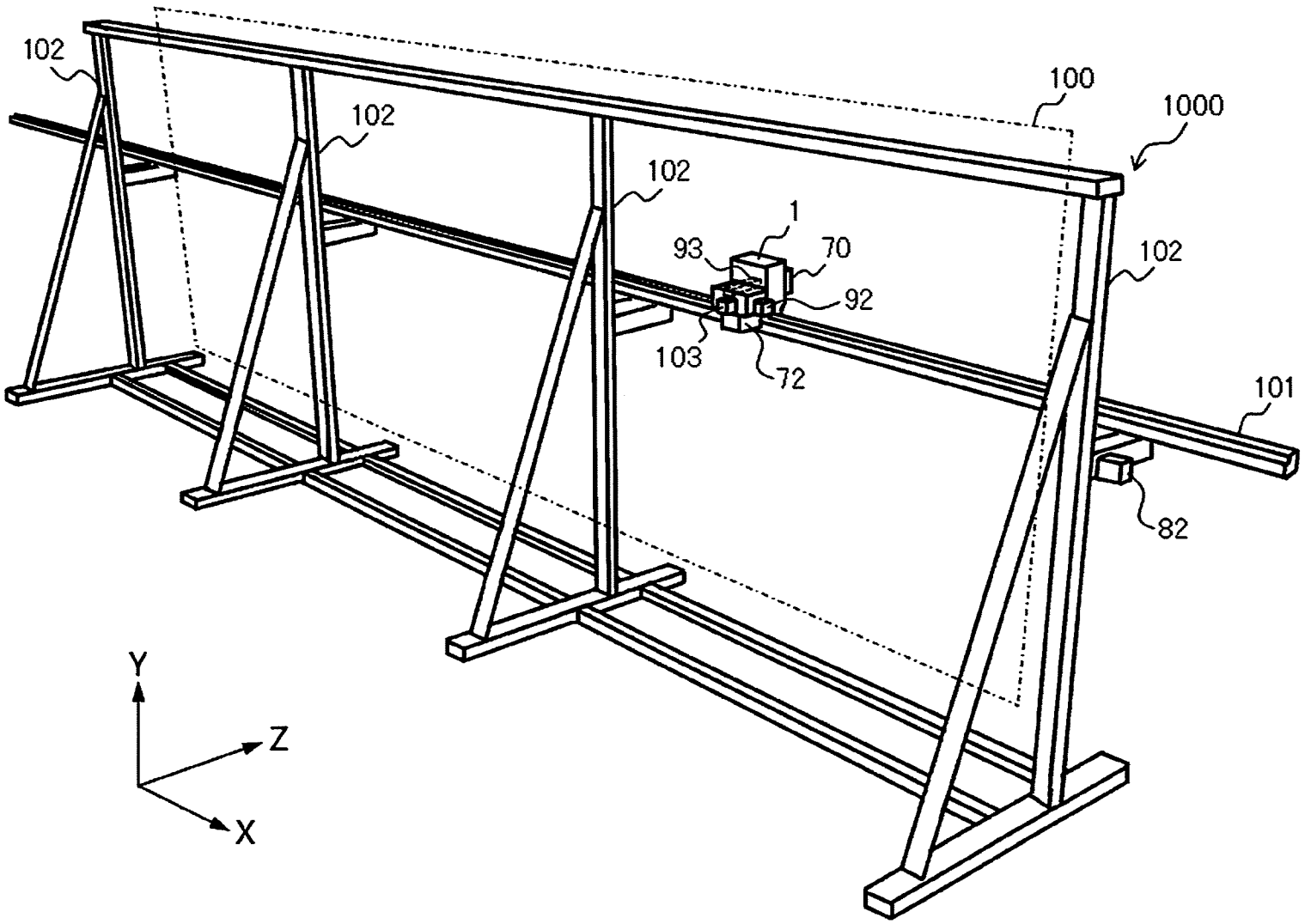
FIG. 1 is a schematic perspective view of a liquid discharge apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a", "an", and "the" are intended to include the plural forms as well, unless the context clearly indicates otherwise.

It will also be understood that when an element is referred to as being "connected" or "coupled" to another element, it can be directly connected or coupled to another element or intervening elements may be present. In contrast, when an element is referred to as being "directly connected" or "directly coupled" to another element, there are no intervening elements present. Thus, the term "connected/coupled" includes both direct connections and connections in which there are one or more intermediate connecting elements.

Hereinafter, embodiments of the present invention are described with reference to the drawings.

FIG. 1 is a schematic perspective view of a liquid discharge apparatus 1000 according to a first embodiment of the present disclosure.

The liquid discharge apparatus 1000 is installed to face a drawing object 100 which is an example of an object. The liquid discharge apparatus 1000 includes an X-axis rail 101, a Y-axis rail 102, and a Z-axis rail 103. The Y-axis rail 102 intersects the X-axis rail 101, and the Z-axis rail 103 intersects the X-axis rail 101 and the Y-axis rail 102.

The Y-axis rail 102 holds the X-axis rail 101 so that the X-axis rail 101 is movable in a Y-direction (vertical direction in FIG. 1). The X-axis rail 101 holds the Z-axis rail 103 so that the Z-axis rail 103 is movable in an X-direction (horizontal direction in FIG. 1). The Z-axis rail 103 holds the carriage 1 so that the carriage 1 is movable in a Z-direction (another horizontal direction orthogonal to the X-direction). Here, the carriage 1 is an example of a liquid discharge unit.

The liquid discharge apparatus 1000 includes a first Z-direction driver 92 and an X-direction driver 72. The first Z-direction driver 92 moves the carriage 1 in the Z-direction along the Z-axis rail 103. The X-direction driver 72 moves the Z-axis rail 103 in the X-direction along the X-axis rail 101.

The liquid discharge apparatus 1000 further includes a Y-direction driver 82 that moves the X-axis rail 101 in the Y-direction along the Y-axis rail 102. The liquid discharge apparatus 1000 further includes a second Z-direction driver 93 that moves a head holder 70 in the Z-direction with respect to the carriage 1. Here, the head holder 70 is an example of a holder.

The liquid discharge apparatus 1000 having the above-described configuration discharges ink, as an example of a liquid, from a head on the head holder 70 while moving the carriage 1 in the X-direction, the Y-direction, and the Z-direction to perform drawing on the drawing object 100. A moving direction of the carriage 1 and the head holder 70 in the Z-direction is not necessarily in parallel with the Z-direction. The moving direction of the carriage 1 and the head holder 70 in the Z-direction may be inclined with the Z-direction as long as the moving direction of the carriage 1 and the head holder 70 includes at least a component in the Z-direction.

A surface shape of the drawing object 100 is plane in FIG. 1. The surface shape of the drawing object 100 may be a nearly vertical surface such as a vehicle body of a car or a truck or a fuselage of an aircraft. The surface shape of the drawing object 100 may also be a surface having a large radius of curvature.

Next, a configuration of the carriage 1 is described below.

Figure 2:
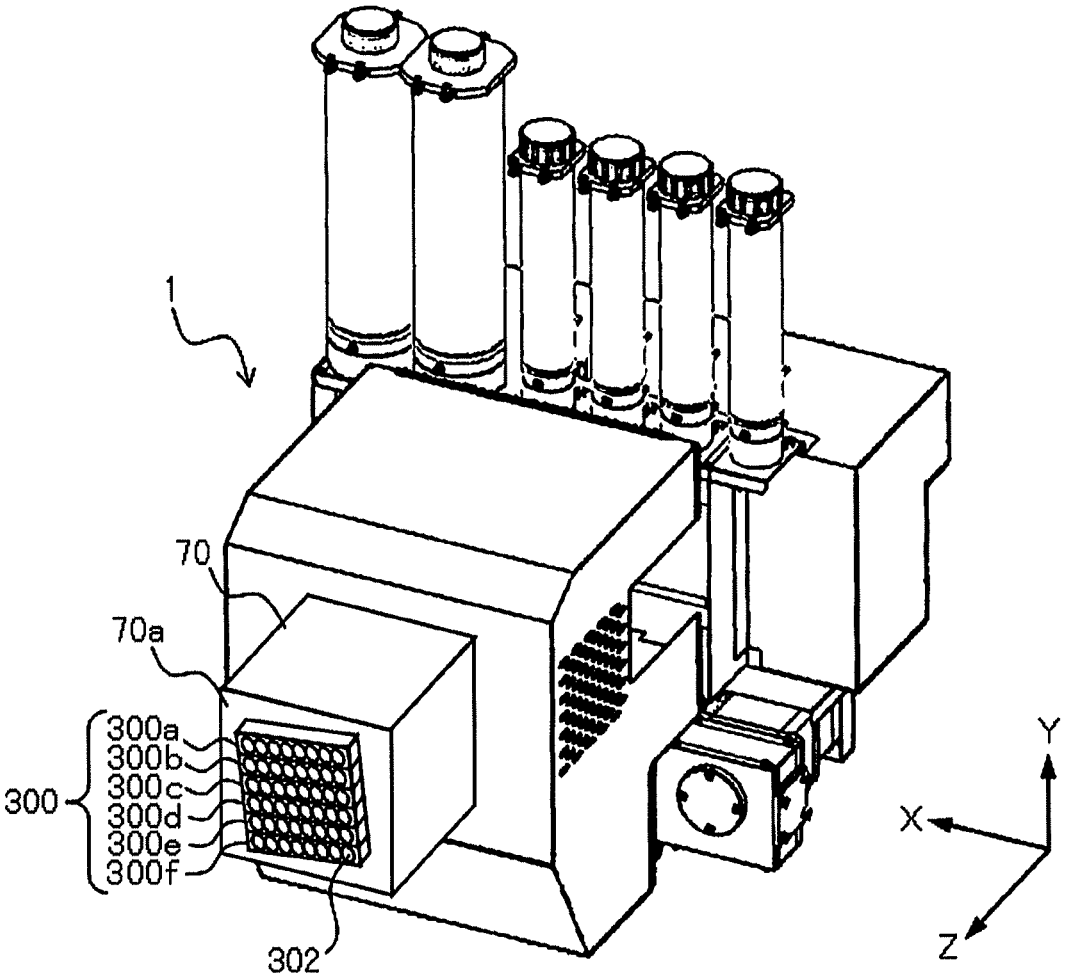
FIG. 2 is a schematic perspective view of a carriage of the liquid discharge apparatus according to the first embodiment of the present disclosure.

FIG. 2 is a schematic perspective view of the carriage 1 of the liquid discharge apparatus 1000 according to the first embodiment of the present disclosure.

The carriage 1 includes the head holder 70. Further, the carriage 1 is movable in the Z-direction along the Z-axis rail 103 by a power applied by the first Z-direction driver 92 as illustrated in FIG. 1. The head holder 70 is movable in the Z-direction with respect to the carriage 1 by a power from the second Z-direction driver 93 as illustrated in FIG. 1.

The head holder 70 includes a head fixing plate 70*a* (see FIG. 2) to attach the liquid discharge head 300 to the head holder 70. The liquid discharge head 300 is an example of a liquid discharger.

FIG. 2 illustrates an example of the first embodiment having a configuration in which six liquid discharge heads 300*a* to 300*f* are arranged in a multi-layered manner on the head fixing plate 70*a*. In the following description, these liquid discharge heads 300*a* to 300*f* are collectively referred to as a liquid discharge head 300.

Each of the liquid discharge heads 300*a* to 300*f* includes multiple nozzles 302. A color of ink used in each of the liquid discharge heads 300*a* to 300*f* may be different for each of the liquid discharge head 300 or may be identical color for all liquid discharge heads 300. Further, a number of the liquid discharge heads 300 that configures the liquid discharge head 300 is not limited to six. The number of the liquid discharge heads 300 may be more than six or less than six.

The liquid discharge head 300 is fixed to the head fixing plate 70*a* in a state in which a nozzle array of each of the liquid discharge head 300 intersects a horizontal plane (X-Z plane). Each of the nozzle array includes the multiple nozzles 302. Further, the liquid discharge head 300 is fixed to the head fixing plate 70*a* in a state in which an arrangement direction of the nozzle array of the multiple nozzles 302 is inclined with respect to the X-axis. Thus, the multiple nozzles 302 discharge ink in a direction intersecting a direction of gravity. The nozzle 302 is an example of a liquid discharge port.

Figure 3:
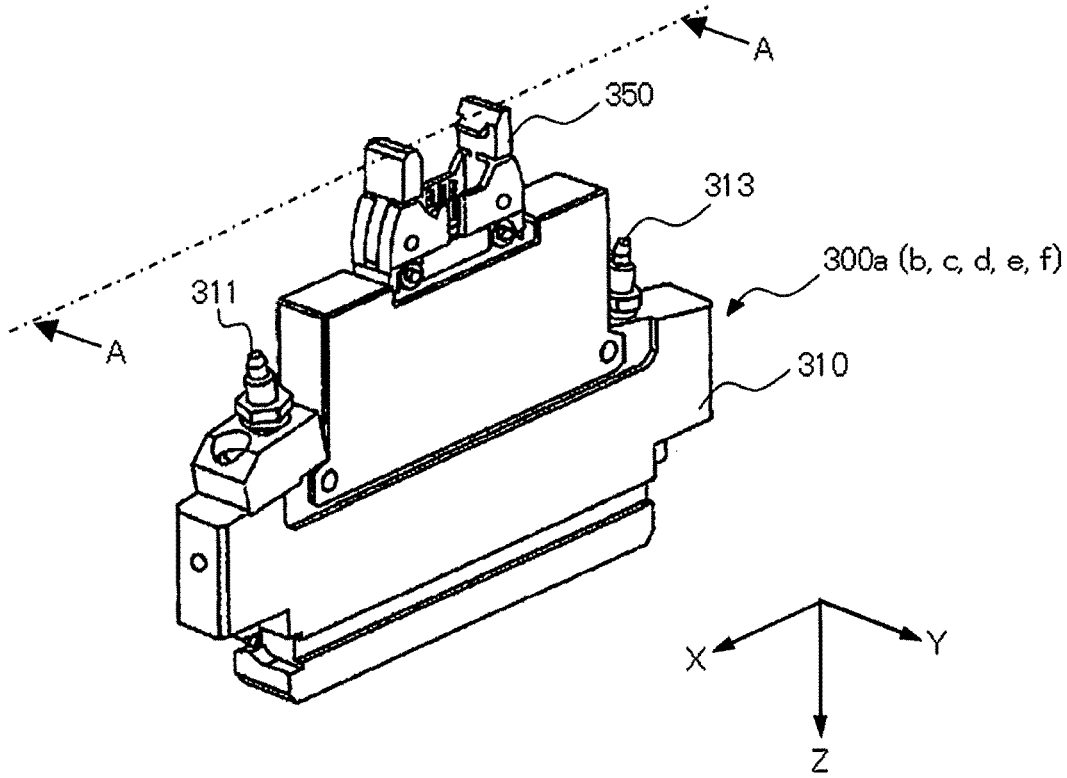
FIG. 3 is an entire perspective view of a single liquid discharge head of the liquid discharge apparatus.

FIG. 3 is an entire perspective view of a single liquid discharge head 300 of the liquid discharge apparatus 1000.

Each of the liquid discharge heads 300*a* to 300*f* includes a housing 310 as illustrated in FIG. 3. The housing 310 is made of metal or resin. The housing 310 may include a connector 350 to communicate electrical signals at an upper portion of the housing 310. The liquid discharge head 300 includes a supply port 311 and a collection port 313. The supply port 311 supplies ink to an interior of the liquid discharge head 300. The collection port 313 is used to discharge ink from the liquid discharge head 300.

Figure 4:
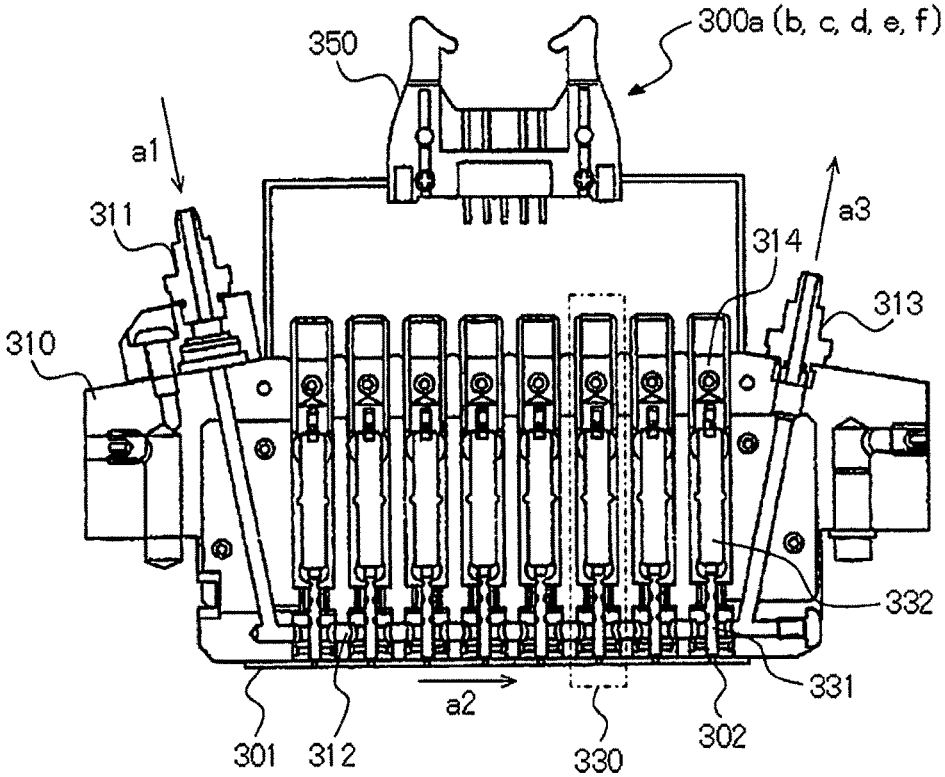
FIG. 4 is an entire cross-sectional view of a single liquid discharge head of the liquid discharge apparatus.

FIG. 4 is an entire cross-sectional view along a line A-A of FIG. 3 of the single liquid discharge head 300.

The housing 310 holds a nozzle plate 301 including the nozzles 302 to discharge ink (see FIG. 4). Further, the housing 310 includes a channel 312 that feeds ink from the supply port 311 to the collection port 313 via an upper portion of the nozzle plate 301.

The liquid discharge head 300 includes liquid discharge modules 330 to discharge the ink in the channel 312 from the nozzles 302 between the supply port 311 and the collection port 313. A number of liquid discharge modules 330 corresponds to a number of nozzles 302. In the example illustrated in FIG. 4, eight liquid discharge modules 330 corresponding to eight nozzles 302 are arranged in one line in X-direction (see FIGS. 3 and 4).

A number and an arrangement of the nozzles 302 and the liquid discharge modules 330 are not limited to eight as described above. For example, the number of the nozzles 302 and the liquid discharge modules 330 may be one rather than plural. Further, the nozzles 302 and the liquid discharge modules 330 may be arranged in multiple rows instead of one row.

With the above-described configuration, the supply port 311 takes in the ink in a pressurized state from an outside of the liquid discharge head 300, feeds the ink in a direction as indicated by an arrow a1, and further feeds (supplies) the ink to the channel 312. The channel 312 feeds ink from the supply port 311 to the collection port 313 in a direction as indicated by an arrow a2 in FIG. 4. Then, the collection port 313 discharges the ink that is not discharged from the nozzles 302 in a direction indicated by arrow a3. The nozzles 302 are arranged along the channel 312 in the X-direction.

The liquid discharge module 330 includes a needle valve 331 that openably closes the nozzle 302 and a piezoelectric element 332 to drive the needle valve 331.

The housing 310 includes a regulator 314 at a position facing an upper end of the piezoelectric element 332. The regulator 314 is in contact with an upper end of the piezoelectric element 332 and serves as a fixing point of the piezoelectric element 332. The needle valve 331 is an example of a valve, and the piezoelectric element 332 is an example of a driver. The piezoelectric element 332 (driver) is also referred to as an "actuator".

In the above configuration, when the piezoelectric element 332 is operated to move the needle valve 331 upward, the nozzle 302 that has been closed by the needle valve 331 is opened so that the ink is discharged from the nozzle 302.

When the piezoelectric element 332 is operated to move the needle valve 331 downward, a leading end of the needle valve 331 comes into contact with the nozzle 302 to close the nozzle 302 so that the ink is not discharged from the nozzle 302.

The liquid discharge head 300 may temporarily stops a discharge operation of the ink from the collection port 313 to prevent a decrease in a discharge efficiency of the ink from the nozzle 302 during discharging the ink to the drawing object 100 (see FIG. 1).

Figure 5B:
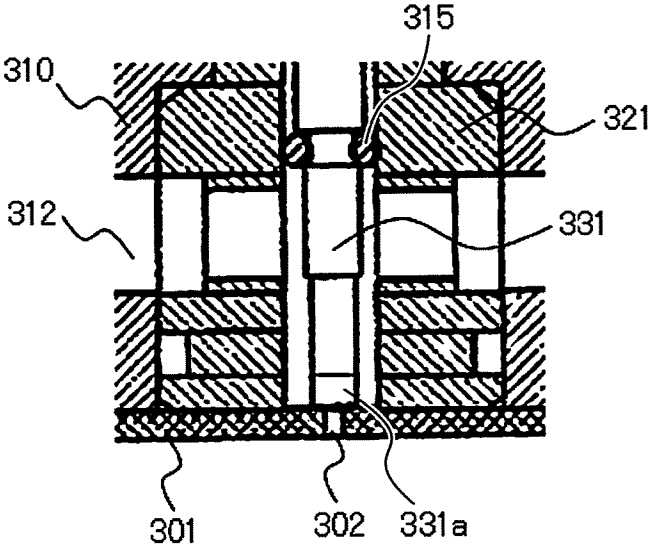
FIGS. 5A and 5B are schematic cross-sectional views of a single liquid discharge module that forms a part of the liquid discharge head.
Figure 5A:
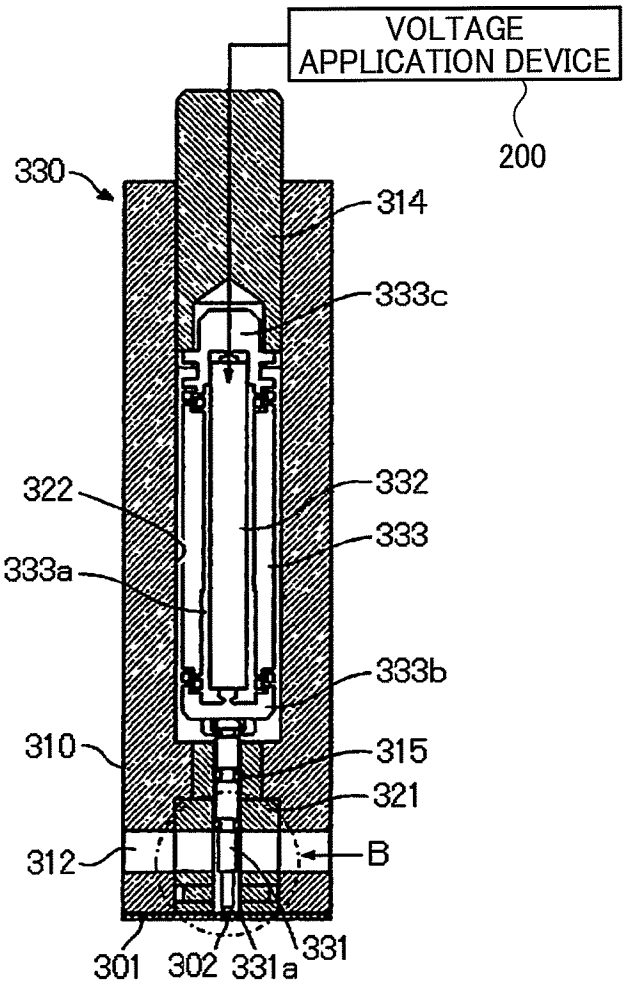

FIGS. 5A and 5B are schematic cross-sectional views of a single liquid discharge module 330 that forms a part of the liquid discharge head.

FIG. 5A is a general cross-sectional view of the liquid discharge module 330.

FIG. 5B is a partial enlarged view of the liquid discharge module 330 as illustrated in a part indicated by a dotted circle "B" in FIG. 5A.

The liquid discharge module 330 includes a needle valve 331 that openably closes the nozzle 302 and a piezoelectric element 332 to drive the needle valve 331. The nozzle plate 301 is joined to the housing 310. Further, the channel 312 is a channel common to the multiple liquid discharge modules 330 in the housing 310.

The needle valve 331 includes an elastic member 331*a* at the leading end of the needle valve 331 so that the needle valve 331 can reliably close the nozzle 302 when the leading end of the needle valve 331 is pressed against the nozzle plate 301. The liquid discharge module 330 includes a bearing 321 and a seal 315. The bearing 321 is disposed between the needle valve 331 and the housing 310. The seal 315 such as an O-ring is disposed between the bearing 321 and the needle valve 331.

The piezoelectric element 332 is accommodated in a space 322 of the housing 310. The piezoelectric element 332 is held in a central space 333*a* of a holder 333. The piezoelectric element 332 and the needle valve 331 are coaxially coupled to each other via a leading end 333*b* of the holder 333. Thus, the holder 333 has the central space 333*a* to accommodate the piezoelectric element 332. The leading end 333*b* of the holder 333 is coupled to the needle valve 331. A rear end 333*c* of the holder 333 is fixed by a regulator 314 attached to the housing 310.

The piezoelectric element 332 drives and moves the needle valve 331 in a direction to open the nozzle 302 when a voltage is applied by the voltage application device 200. The needle valve 331 closes the nozzle 302 when no voltage is applied to the piezoelectric element 332. Thus, even if the ink is pressurized and supplied to the channel 312, the liquid is not discharged from the nozzle 302. A voltage is applied to the piezoelectric element 332 to cause the piezoelectric element 332 to contract and pull the needle valve 331 via the holder 333 so that the needle valve 331 is separated from the nozzle 302 to open the nozzle 302. Thus, the ink pressurized and supplied to the channel 312 is discharged from the nozzle 302.

Figure 6:
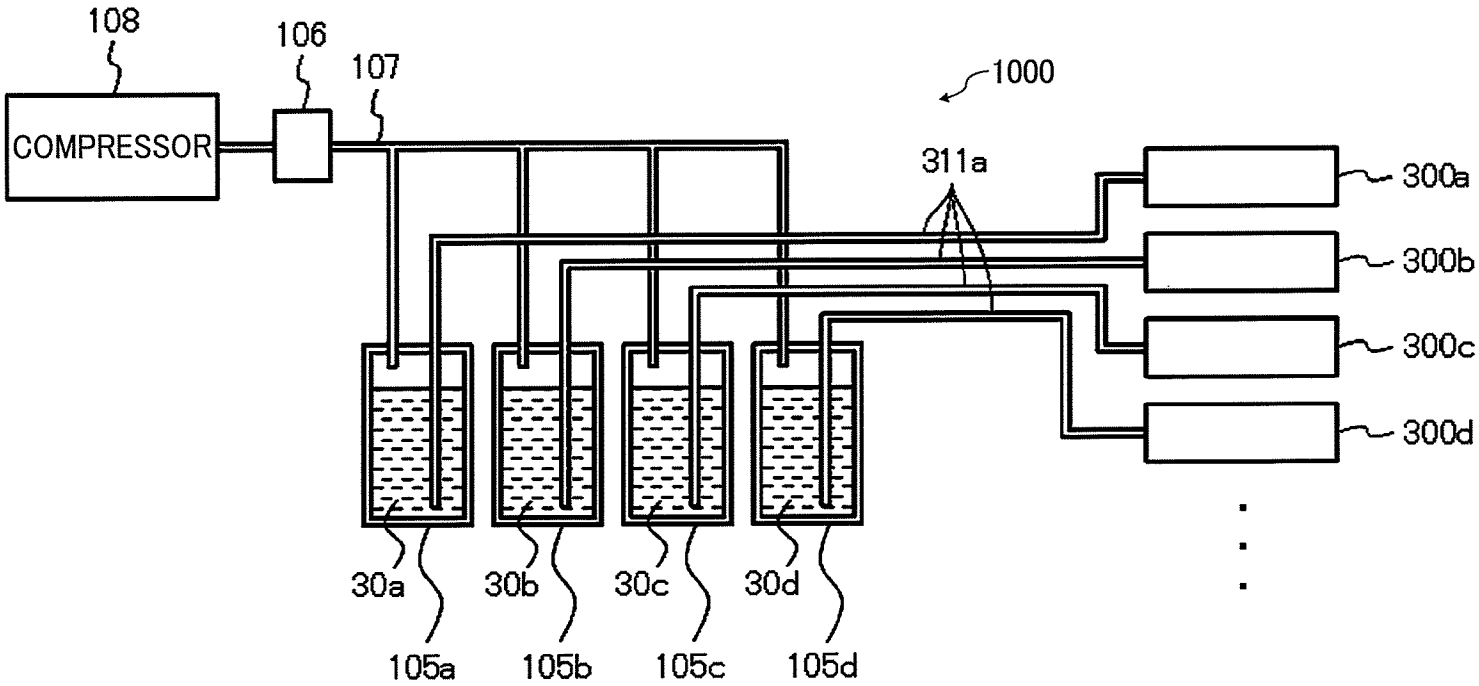
FIG. 6 is a schematic circuit diagram of a liquid supply unit according to the first embodiment.

FIG. 6 is a schematic circuit diagram of a liquid supply unit according to the first embodiment.

The liquid discharge apparatus 1000 includes tanks 105*a* to 105*d* as closed containers that accommodate ink 30*a* to 30*d* respectively discharged from the liquid discharge heads 300*a* to 300*d*. In the following description, these inks are collectively referred to as the ink 30. The tanks 105*a* to 105*d* may be collectively referred to as a tank 105.

The tanks 105 and the supply port 311 in FIGS. 3 and 4 (injection ports) of the liquid discharge head 300 are respectively connected to each other via tubes 311*a*. The tanks 105 are coupled to a compressor 108 via a pipe 107 including an air regulator 106. The compressor 108 supplies pressurized air to the tanks 105. Accordingly, the ink 30 is discharged from the nozzle 302 when the needle valve 331 as described above is opened since the ink 30 in the liquid discharge head 300 is in a pressurized state. The pipe 107 including the compressor 108 and the air regulator 106, the tanks 105, and the tubes 311*a* collectively forms an example of a liquid supply unit that pressurizes and supplies the ink 30 to the liquid discharge head 300.

Figure 7A:
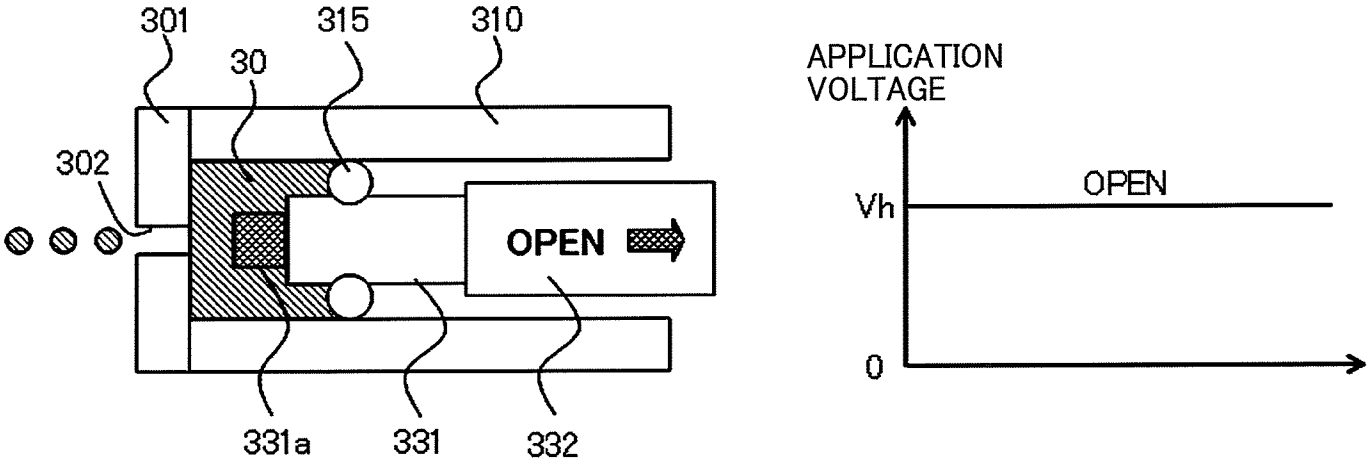
FIGS. 7A and 7B are schematic cross-sectional views of the liquid discharge head in a liquid discharge operation.
Figure 7B:
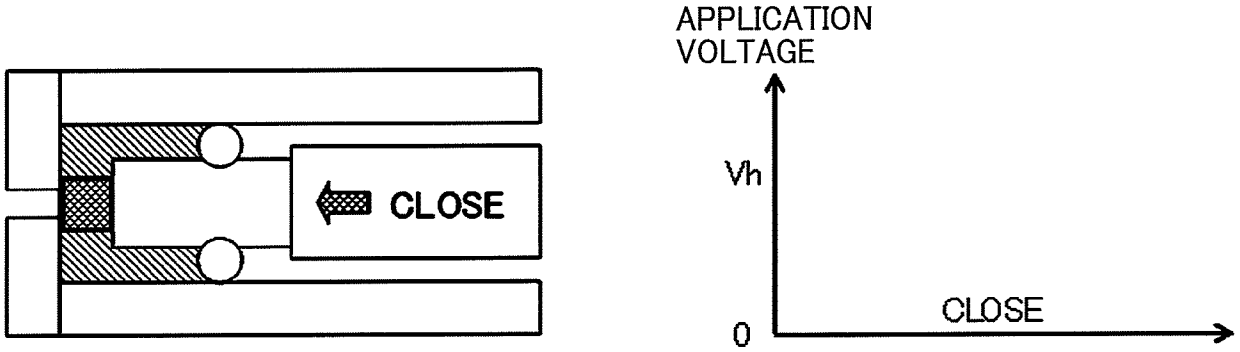

FIGS. 7A and 7B are schematic cross-sectional views of the liquid discharge head 300 in a liquid discharge operation.

FIG. 7A is a schematic cross-sectional view of the liquid discharge head 300 during a discharge operation and an application voltage (drive voltage) applied to the piezoelectric element 332 at a time of the liquid discharge operation.

FIG. 7B is a schematic cross-sectional view of the liquid discharge head 300 during a non-discharge operation and the application voltage (drive voltage) applied to the piezoelectric element 332 at a time of the non-discharge operation.

As illustrated in FIG. 7A, the piezoelectric element 332 contracts in a longitudinal direction of the piezoelectric element 332 due to application of a predetermined voltage Vh to the piezoelectric element 332. The application of the predetermined voltage Vh is an application of relatively large voltage, for example, a voltage larger than 0V.

Thus, the piezoelectric element 332 contracts to move the needle valve 331 to a righthand side as indicated by an arrow in FIG. 7A. As a result, the nozzle 302 opens, and the ink 30 is discharged from the nozzle 302.

As illustrated in FIG. 7B, when the application voltage applied to the piezoelectric element 332 is set to 0V (that is, a relatively small voltage is applied), the piezoelectric element 332 expands and returns to its original position. The relatively small voltage is, for example, a voltage smaller than the predetermined voltage Vh.

Thus, the piezoelectric element 332 expands to move the needle valve 331 to a left-hand side as indicated by an arrow in FIG. 7B. As a result, the nozzle 302 closes, and the ink 30 is prevented from discharging from the nozzle 302.

The voltage is set to 0V when the nozzle 302 is closed in this embodiment. However, a voltage other than 0V may be used as long as the voltage is smaller than the predetermined voltage Vh.

Figure 8:
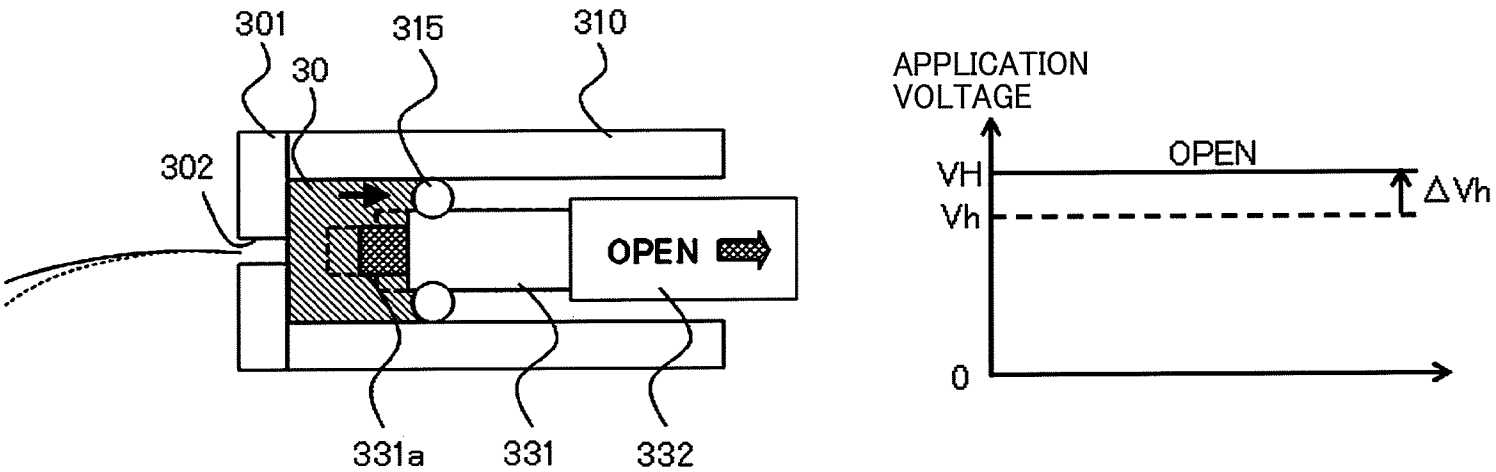
FIG. 8 is a schematic cross-sectional view of the liquid discharge head illustrating an application voltage control of the piezoelectric element.

FIG. 8 is a schematic cross-sectional view of the liquid discharge head 300 illustrating an application voltage control of the piezoelectric element 332.

As illustrated in FIG. 4 and the like, the liquid discharge head 300 in the liquid discharge apparatus 1000 in the first embodiment has a configuration in which the ink 30 flowing through the channel 312 coupling the supply port 311 and the collection port 313 is used in the multiple liquid discharge modules 330.

For example, a pressure applied to each discharge port such as the nozzle 302 in the liquid discharge head 300, when the ink is discharged from one nozzle 302 among eight nozzles 302 arranged in one line, changes (is different) from a pressure applied to each discharge port in the liquid discharge head 300, when the ink is discharged from all of the eight nozzles 302 since a total area of the discharge ports (nozzles 302), from which the liquid is discharged, changes.

Variations in discharge characteristics such as a discharge amount of ink 30 and a discharge speed occur since the pressure applied to each discharge port (nozzle 302) changes according to a number of needle valves 331 that are simultaneously driven among the multiple needle valves 331. Variations in discharge characteristics occurs since a flow quantity and flow rate of ink 30 supplied from the supply port 311 to the channel 312 are approximately constant regardless of the number of needle valves 331 to be simultaneously driven.

On the other hand, a flow quantity and a discharge flow rate of ink 30 discharged from one nozzle 302 decrease as a number of the needle valves 331 to be simultaneously driven increases. The number of the needle valves 331 to be simultaneously driven (driven at the same time) corresponds a total cross-sectional area of the nozzles 302 opened simultaneously (opened at the same time).

Particularly, the variations in discharge characteristics are significant in a structure in which individual chambers are connected to each other by a channel, that is, a structure in which the individual chambers are connected in series. It is significantly reduced the flow quantity and the discharge flow rate of the ink 30 discharged from the nozzle 302 positioned on a downstream in a flow direction of the ink 30 in the channel 312 among the multiple nozzles 302 fluidly connected in series.

Therefore, the liquid discharge apparatus 1000 in the first embodiment controls to increase the application voltage applied to the piezoelectric element 332 according to an increase in the number of needle valves 331 to be simultaneously driven (driven valves) among the multiple needle valves 331 as illustrated in FIG. 8. As the number of needle valves 331 to be simultaneously driven increases, a correction amount ΔVh (that is, increase amount) to be added to the reference drive voltage Vh is increased. The application voltage VH (drive voltage VH) applied to the piezoelectric element 332 is controlled to be increased as the number of needle valves 331 to be simultaneously driven increases.

Thus, the piezoelectric element 332 is further displaced and a moving amount of the needle valve 331 increases. As a moving amount of the needle valve 331 increases and a displacement of the needle valve 331 increases, the needle valve 331 retracts to a position farther from the nozzle 302 in the channel 312. Then, a decrease in a pressure loss occurs while the ink 30 flows from the supply port 311 to the nozzle 302. The pressure loss is caused by the needle valve 331 obstructing a liquid flow in the vicinity of the nozzle 302. Thus, the liquid discharge apparatus 1000 can prevent a decrease in the flow quantity and the discharge flow rate of the ink 30 discharged from each nozzle 302 (from one nozzle 302). As a result, the fluid resistance between the nozzle 302 and the needle valve 331 is reduced, and the discharge characteristics of the ink 30 are improved.

Figure 9:
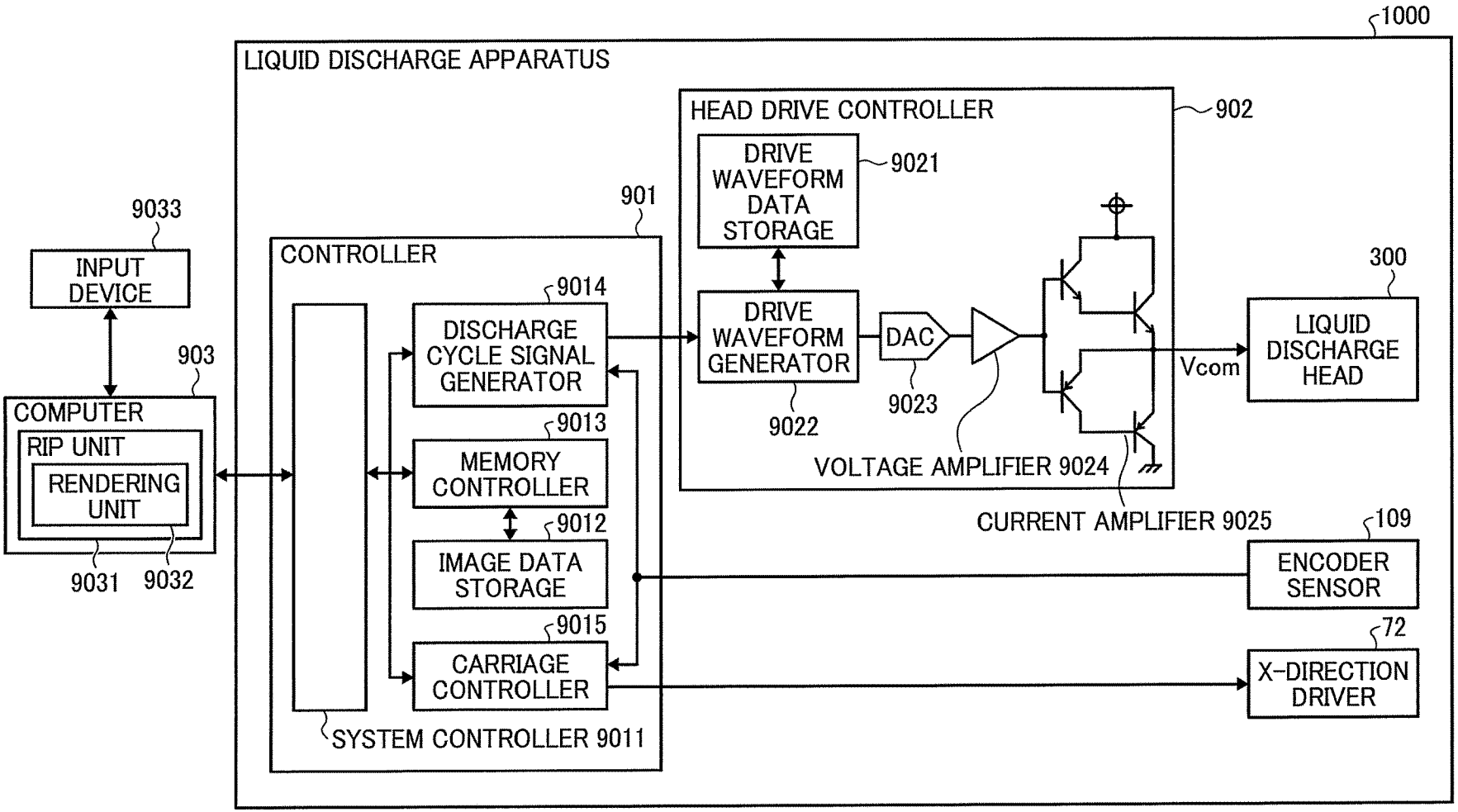
FIG. 9 is a block diagram illustrating an example of a control system of the liquid discharge apparatus.

FIG. 9 is a block diagram illustrating an example of a control configuration of the liquid discharge apparatus 1000.

The liquid discharge apparatus 1000 includes a controller 901, a head drive controller 902, the liquid discharge head 300, an encoder sensor 109, the X-direction driver 72, and the like. A computer 903 is connected to the controller 901. The computer 903 may be a personal computer (PC). The computer 903 includes a routing information protocol (RIP) unit 9031, a rendering unit 9032, and the like. The RIP unit 9031 has a function of performing image processing in accordance with a color profile and user settings.

The rendering unit 9032 has a function of decomposing image data to be drawn on the drawing object 100 (see FIG. 1) into image data for each scan, for example, for each unit in which the carriage 1 draws an image by one movement in the X-direction. Further, an input device 9033 is connected to the computer 903. The input device 9033 includes a keyboard, a mouse, a touch panel, a voice input device, or the like. The input device 9033 receives inputs from a user such as setting of image data and coordinate data to be drawn on the drawing object 100 and selection of a drawing mode.

The controller 901 includes a system controller 9011, an image data storage 9012, a memory controller 9013, a discharge cycle signal generator 9014, a carriage controller 9015, and the like. The system controller 9011 receives image data and commands from the computer 903 and controls an entire operation of the liquid discharge apparatus 1000. The image data storage 9012 includes a memory such as a read only memory (ROM), a random access memory (RAM), or a hard disk drive (HDD), and stores image data received from the computer 903. The memory controller 9013 writes image data and the like to the image data storage 9012 and reads image data and the like from the image data storage 9012 based on commands from the system controller 9011.

The discharge cycle signal generator 9014 generates a discharge cycle signal of the ink 30 based on an output signal of the encoder sensor 109 and information indicating a resolution of image data received from the computer 903.

The encoder sensor 109 optically detects a slit in a linear encoder installed along the X-axis rail 101 of the liquid discharge apparatus 1000 and generates the above-described output signal, for example. The encoder sensor 109 is not limited to a linear encoder method as long as the encoder sensor 109 can detect a position of the carriage 1 in the X-direction. For example, a method of counting a rotation of a drive motor of the X-direction driver 72 may be used for the encoder sensor 109 other than the linear encoder method.

The carriage controller 9015 calculates positional information of the carriage 1 based on the output signal of the encoder sensor 109 and controls a speed of the X-direction driver 72. The system controller 9011 calculates a changing amount in a moving speed of the carriage 1 in this first embodiment. The system controller 9011 controls the speed of the carriage 1 based on this changing amount in the moving speed of the carriage 1.

As described above, the controller 901 includes the system controller 9011, the image data storage 9012, the memory controller 9013, the discharge cycle signal generator 9014, the carriage controller 9015, and the like. The controller 901 includes an arithmetic processor and a storage and controls the arithmetic processor to execute a program previously stored in the storage to perform the above functional units.

Next, a configuration of the head drive controller 902 is described below. The head drive controller 902 controls driving of the liquid discharge head 300. The head drive controller 902 includes a drive waveform data storage 9021, a drive waveform generator 9022, a digital analog converter 9023 (DAC), a voltage amplifier 9024, a current amplifier 9025, and the like. The drive waveform data storage 9021 stores a drive waveform to drive the liquid discharge head 300.

The drive waveform generator 9022 outputs the drive waveform data read from the drive waveform data storage 9021 to the DAC 9023 in response to the discharge cycle signal received from the discharge cycle signal generator 9014. The DAC 9023 converts the drive waveform data received from the drive waveform generator 9022 into analog data and outputs the analog data to the voltage amplifier 9024. The voltage amplifier 9024 amplifies the voltage of the analog data received from the DAC 9023. The current amplifier 9025 amplifies a current of the analog data received from the voltage amplifier 9024.

As described above, the head drive controller 902 includes the drive waveform data storage 9021, the drive waveform generator 9022, the DAC 9023, the voltage amplifier 9024, the current amplifier 9025, and the like. The liquid discharge apparatus 1000 uses the drive waveform generated by the head drive controller 902 to drive and control the needle valve 331 for each nozzle of the liquid discharge head 300.

Note that a control configuration illustrated in FIG. 9 is an example, and is not limited to the configuration as illustrated in FIG. 9. For example, the RIP unit 9031 and the rendering unit 9032 may be provided not in the computer 903 but in the system controller 9011 of the controller 901.

As described above, the liquid discharge apparatus 1000 in the first embodiment includes the liquid discharge head 300, a liquid supply unit (see FIG. 6), and various controllers. The liquid discharge head 300 includes the multiple nozzles 302 to discharge ink 30, the multiple needle valves 331 corresponding to the multiple nozzles 302, and the multiple piezoelectric elements 332 to open and close the nozzles 302 by driving the multiple needle valves 331, respectively.

The liquid supply unit (see FIG. 6) includes the compressor 108, the pipe 107 including the air regulators 106, the tanks 105, and tubes 311*a* to pressurize and supply the ink 30 to the liquid discharge heads 300. The various controllers include the controller 901, the head drive controller 902, and the computer 903 to control the application voltage Vh applied to the piezoelectric elements 332 according to a number of the needle valves 331 simultaneously driven among the multiple needle valves 331.

Accordingly, the liquid discharge apparatus 1000 can accurately discharge a liquid even when the liquid is simultaneously discharged from the multiple nozzles 302 (liquid discharge ports).

Figure 10:
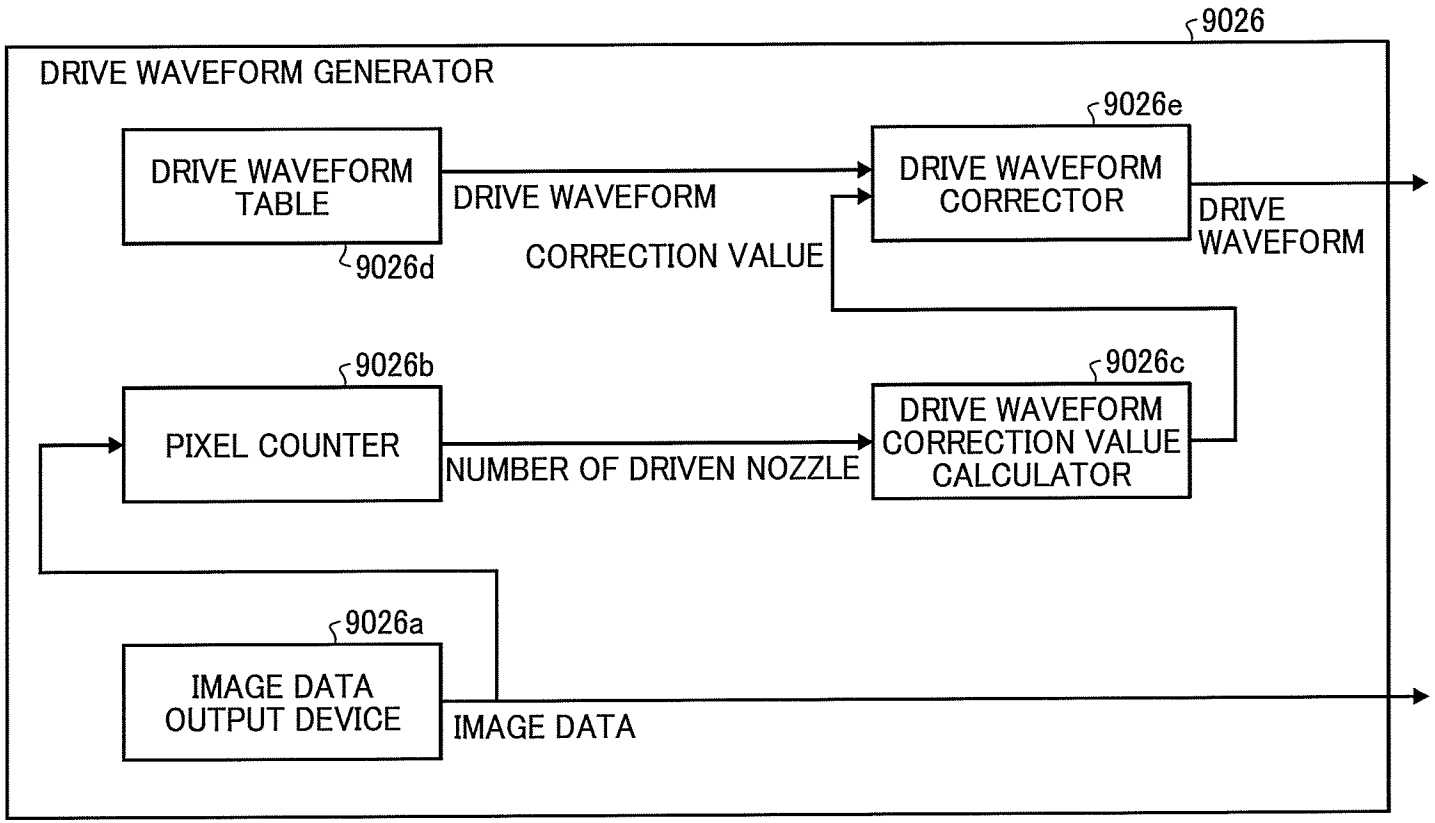
FIG. 10 is a block diagram illustrating another embodiment of the drive waveform generator.

FIG. 10 is a block diagram illustrating another embodiment of the drive waveform generator 9026.

The drive waveform generator 9022 in the head drive controller 902 as illustrated in FIG. 9 may be configured as the drive waveform generator 9026 as illustrated in FIG. 10. The drive waveform generator 9026 includes an image data output device 9026*a*, a pixel counter 9026*b*, a drive waveform correction value calculator 9026*c*, a drive waveform table 9026*d*, and a drive waveform corrector 9026*e*.

The image data output device 9026*a* specifies image data used for discharging ink 30 in a next cycle based on the image data received from the controller 901. Then, the image data output device 9026*a* outputs the specified image data to the pixel counter 9026*b*. The image data output device 9026*a* outputs image data at a predetermined cycle, for example, for each scan.

The pixel counter 9026*b* counts a number of nozzles 302 simultaneously driven in the liquid discharge head 300 based on the image data received from the image data output device 9026*a*. The pixel counter 9026*b* outputs the number of nozzles 302 to the drive waveform correction value calculator 9026*c* after counting the number of simultaneously driven nozzles 302.

The drive waveform table 9026*d* previously stores a table indicating a relation between the number of driven nozzles 302 and a drive voltage correction amount. Details of the table is described below. The drive waveform correction value calculator 9026*c* acquires a drive waveform correction value based on information indicating the number of driven nozzles 302 received from the pixel counter 9026*b* and table information of the drive waveform table 9026*d*. The drive waveform correction value calculator 9026*c* calculates a head drive voltage changing amount (ΔVh in FIG. 8) and further corrects the acquired drive waveform correction value.

The drive waveform corrector 9026*e* performs a correction process based on the correction values received from the drive waveform correction value calculator 9026*c* and the drive waveforms stored in the drive waveform table 9026*d*. The liquid discharge apparatus 1000 outputs the drive waveform on which the correction process is performed by the drive waveform corrector 9026*e* to perform drive control of the needle valve 331 for each nozzle 302 of the liquid discharge head 300.

Figures 11, 12:
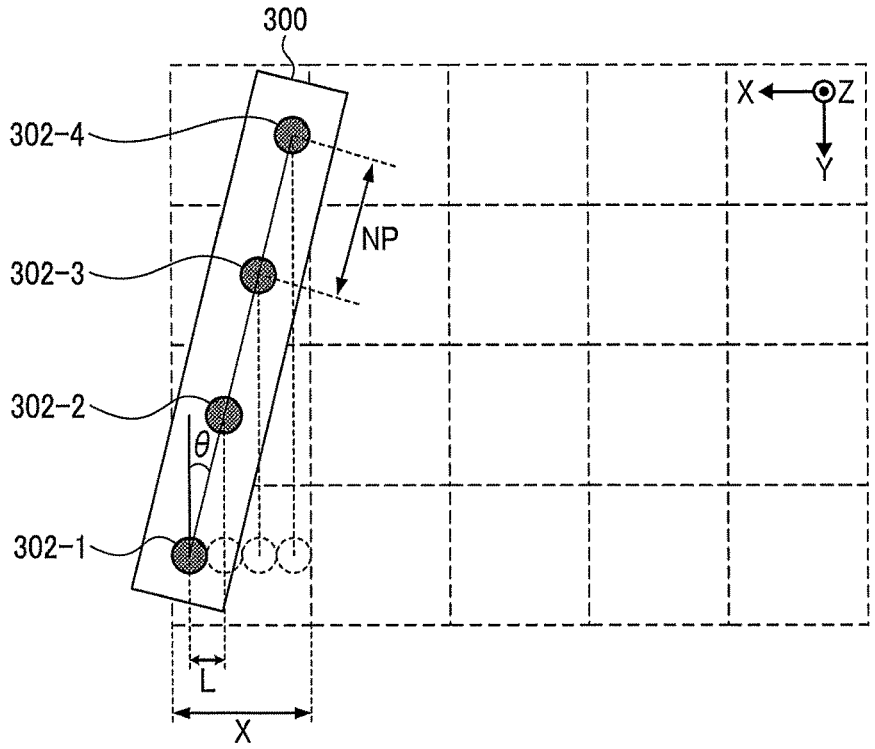
FIG. 11 is a table illustrating an example of the drive waveform table.
FIG. 12 is a schematic plan view of the liquid discharge head installed to reduce a simultaneous driving of needle valves.

FIG. 11 is a control table illustrating an example of the drive waveform table 9026*d*.

FIG. 11 illustrates an example of the control table in which a set value of the air pressure, a number of nozzles 302 (needle valves 331) to be simultaneously driven, and a correction amount of the application voltage (drive voltage) are associated with each other. Multiple setting values of the air pressures may be prepared as illustrated in FIG. 11. For example, the air pressure may be selectively used depending on ink characteristics, for example, the air pressure may be set to 0.45 for color inks (C, M, Y, K, etc.) and set to 0.3 for white ink. When the number of simultaneously driven nozzles is one, the drive voltage correction amounts A1 and A2 are zero volts (0V). The drive voltage correction amount increases from A1 to H1 and from A2 to H2.

A drive voltage VH is derived by adding the correction amount ΔVh to the reference drive voltage Vh using this drive waveform table.

As described above, the needle valve 331 is closed when a voltage is not applied to the piezoelectric element 332, and the needle valve 331 is opened when a voltage is not applied to the piezoelectric element 332 so that an ink 30 is discharged from the nozzle 302 in the liquid discharge head 300.

Thus, even when a power supply is cut off due to an emergency or the like, the needle valve 331 closes the nozzle 302 to reliably stop ink 30 from discharging from the nozzle 302.

As described above, when a number of needle valves 331 to be simultaneously driven among the multiple needle valves 331 is large, the application voltage applied to the piezoelectric element 332 is increased as compared with the application voltage applied to the piezoelectric element 332 when a number of needle valves 331 to be simultaneously driven is small. The application voltage applied to the piezoelectric element 332 is increased by correcting the voltage Vh to the voltage VH.

When the number of needle valves 331 to be simultaneously driven among the multiple needle valves 331 is large, a moving amount of the needle valves 331 is made larger than a moving amount of the needle valves 331 when the number of the needle valves 331 to be simultaneously driven is small.

As described above, the application voltage applied to the piezoelectric element 332 is controlled in accordance with the drive waveform table 9026*d* in which the number of needle valves 331 to be simultaneously driven (driven valves) among the multiple needle valves 331 is associated with the correction amount of the application voltage applied to the piezoelectric element 332.

Thus, the liquid discharge apparatus 1000 can reduce the fluid resistance between the nozzle 302 and the needle valve 331 and improve the discharge characteristics of the liquid discharge head 300 to discharge the ink 30.

In the drive voltage correction amounts B1 to H1 and B2 to H2 when the number of nozzles 302 simultaneously driven is two or more, a drive voltage correction amount of the nozzle 302 positioned on a downstream side in an ink flow direction in the channel 312 may be made larger than a drive voltage correction amount of the nozzle 302 positioned on an upstream side in the ink flow direction in the channel 312 among the multiple nozzles 302 liquidly connected in series.

For example, when the number of nozzles 302 simultaneously driven is two, the drive voltage correction amounts of the eight nozzles 302 illustrated in FIG. 4 are referred to as B1(1), B1(2) to B1(8) from an upstream side (left side in FIG. 4) toward a downstream side (right side in FIG. 4) in the ink flow direction as indicated by arrow a2 in FIG. 4.

Then, the drive voltage correction amounts of the eight nozzles 302 illustrated in FIG. 4 are controlled in an order of B1(1)<B1(2)<B1(3)<B1(4)<B1(5)<B1(6)<B1(7)<B1(8).

Two drive voltage correction amounts among the eight drive voltage correction amounts are used as the drive voltage correction amounts for two nozzles 302 (two needle valves 331) to be simultaneously driven among the eight nozzles 302. The two drive voltage correction amounts correspond to the two nozzles 302 to be simultaneously driven. In one nozzle 302 positioned downstream side (right side in FIG. 4) among the multiple nozzles 302 connected in series, a flow of ink 30 is blocked by the needle valve 331 positioned on the upstream side (left side in FIG. 4) of the one nozzle 302 until the ink flows from the supply port 311 to the one nozzle 302, and a pressure loss at the one nozzle 302 increases.

As a result, a flow quantity and a discharge flow rate of the ink 30 discharged from the nozzles 302 positioned on the downstream side (right side in FIG. 4) in the ink flow direction are significantly reduced compared to the flow quantity and the discharge flow rate of the ink 30 discharged from the nozzles 302 positioned on the upstream side (left side in FIG. 4) in the ink flow direction.

Therefore, the drive voltage correction amount of the nozzle 302 positioned on the downstream side is controlled to be larger than the drive voltage correction amount of the nozzle 302 positioned on the upstream side in the ink flow direction. Thus, the liquid discharge apparatus 1000 can prevent a decrease in the flow quantity and the discharge flow rate of the ink 30 discharged from the nozzle 302 on the downstream side in the ink flow direction.

FIG. 12 is a schematic plan view of the liquid discharge head 300 installed to reduce a simultaneous driving of the needle valves 331. To simplify the description, an example, in which the number of nozzles 302 of the liquid discharge head 300 is four, is described below.

When a pitch between dots (inter-dot pitch) is X (mm), the liquid discharge head 300 is inclined by an angle θ so that a shift amount of a nozzle 302-2, a nozzle 302-3, and a nozzle 302-4 with respect to a nozzle 302-1 in the X-direction is ¼ (one quarter) of the pitch X between dots (inter-dot pitch). The inter-dot pitch X is determined according to a resolution (dpi) in the X-direction.

When each nozzle interval of the liquid discharge head 300 is NP, a nozzle interval in the X-direction L is calculated by $L=\frac{1}{4}\times X=NP\times\sin\theta$ (mm). When the number of nozzles 302 is N, $L=1/N\times X=NP\bullet\times\sin\theta$ (where $0°<\theta<90°$).

Assuming that the moving speed of the liquid discharge head 300 in the X-direction is V (mm/s), one driving period T(s) is calculated by T=X/V (s).

The liquid discharge head 300 attached as described above shifts a head driving period (discharge period) of each nozzle 302 by ¼×T(s) with respect to the adjacent nozzles 302. Thus, the driving timings of the nozzles 302 are distributed, and the liquid discharge apparatus 1000 can reduce the number of nozzles 302 to be simultaneously driven.

The number of angles θ is not limited to one and may be multiple angles θ that exist according to a regularity satisfying a following expression.

$$L=(\tfrac{1}{4}+M)\times X=NP\times\sin\theta \text{ (mm) (where } 0°<\theta<90°).$$

Here, M is a positive integer, and (¼+M) in the above expression is set to (1/N+M) when the number of nozzles 302 is N.

As described above, the liquid discharge head 300 is inclined at an angle obtained from the resolution (dpi) in the X-direction and the interval NP between the nozzles 302 in the Y-direction.

Thus, the liquid discharge apparatus 1000 can distribute drive timings of the multiple nozzles 302 and reduce the number of nozzles 302 to be simultaneously driven, that is, the number of needle valves 331 to be simultaneously driven.

Figure 13A:
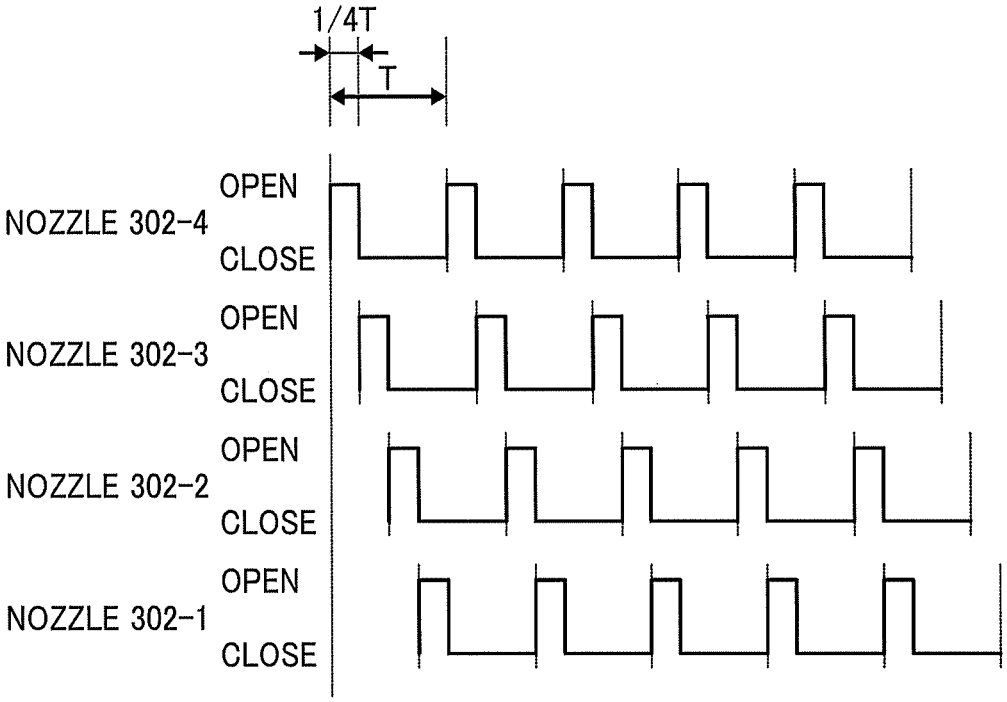
FIGS. 13A and 13B are charts of drive pulses to drive the needle valves (nozzles) to open and close the nozzles.
Figure 13B:
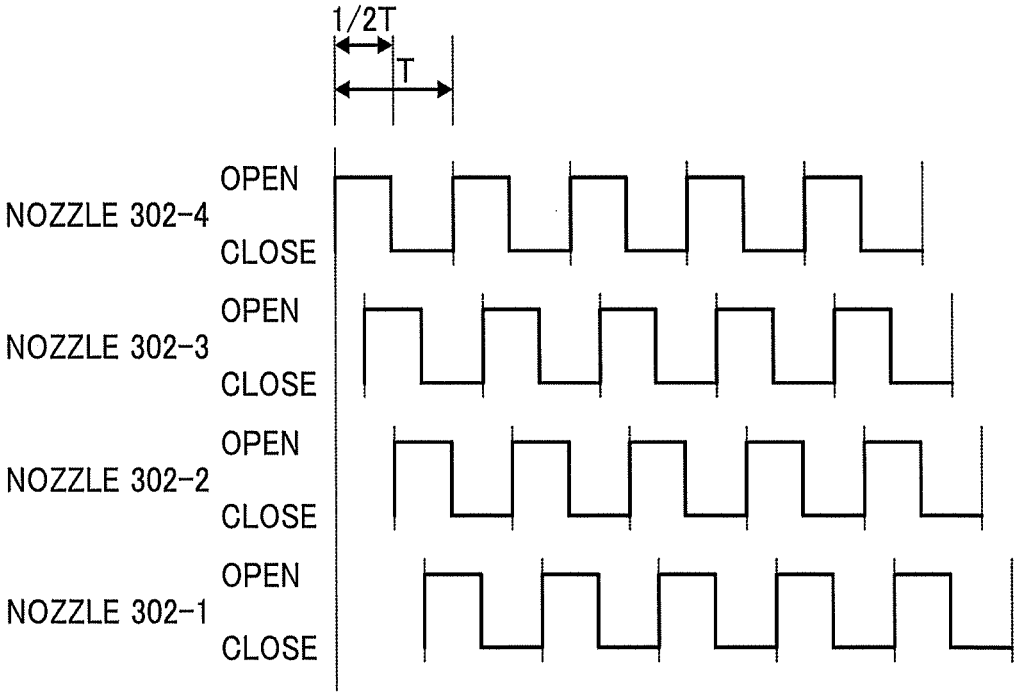

FIGS. 13A and 13B are charts of drive pulses to drive the needle valves 331 (nozzles 302) to open and close the nozzles 302.

FIG. 13A illustrates a state in which an open time of the nozzle 302 is 25% with respect to the discharge cycle T, that is, ¼T.

FIG. 13B illustrates a state in which an open time of the nozzle 302 is 50% with respect to the discharge cycle T, that is, ½T.

In FIG. 13A, although all of the four nozzles 302-1 to 302-4 are driven, the four nozzles 302 are not simultaneously driven. Therefore, a configuration as illustrated in FIG. 13A in combination with the above-described embodiments do not have to correct the application voltage applied to the piezoelectric element 332.

In FIG. 13B, although all of the four nozzles 302-1 to 302-4 are driven, the liquid discharge apparatus 1000 can reduce the number of nozzles 302 to be simultaneously driven to two. Therefore, a configuration as illustrated in FIG. 13B in combination with the above-described embodiments corrects the application voltage applied to the piezoelectric element 332 while the number of nozzles 302 to be simultaneously driven is reduced to two.

Figures 14A, 14B, 14C:
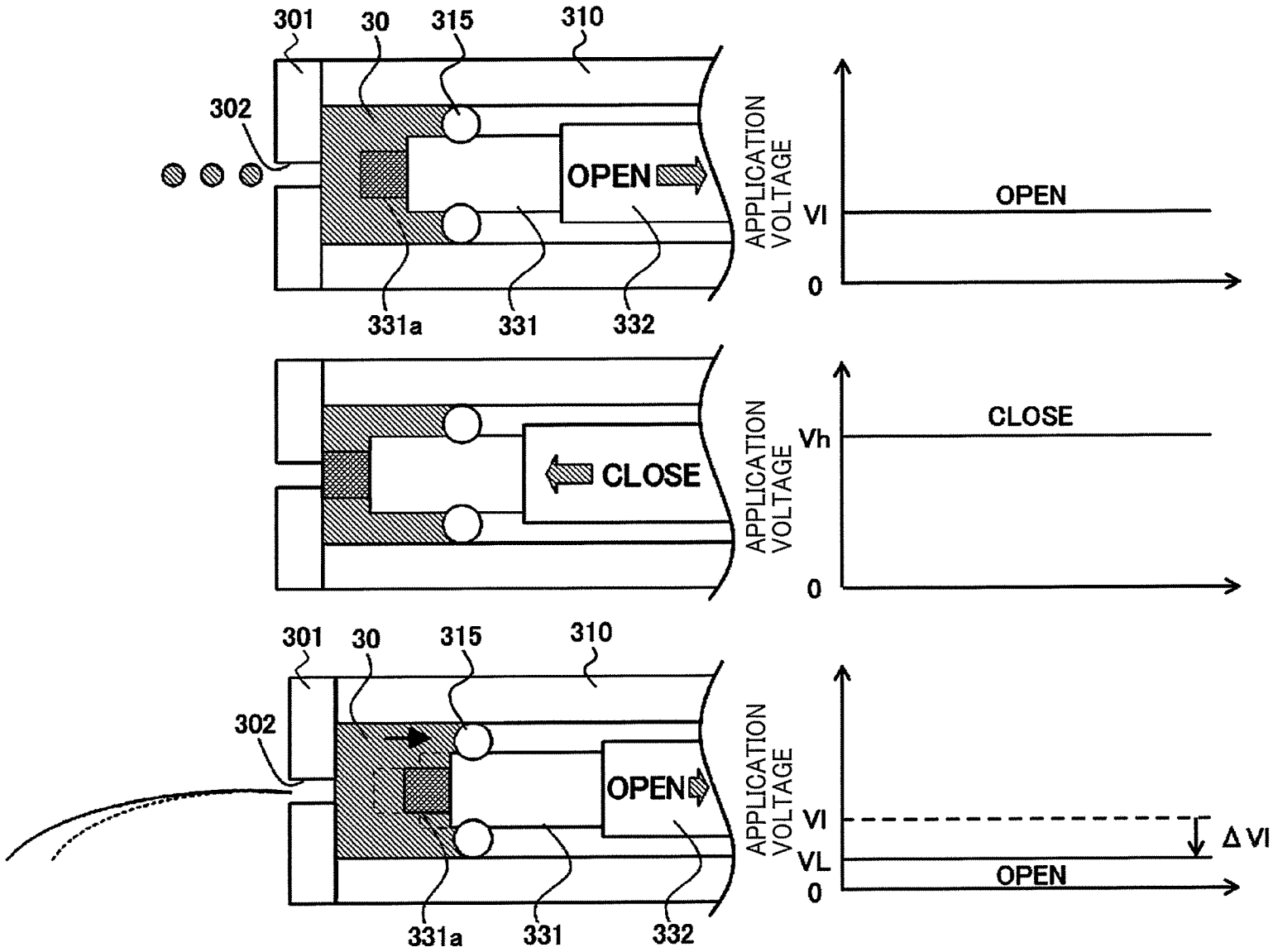
FIGS. 14A to 14C are schematic cross-sectional views of the liquid discharge head according to a Variation 1 in a liquid discharge operation.

FIGS. 14A to 14C are schematic cross-sectional views of the liquid discharge head according to a Variation 1 in a liquid discharge operation.

FIG. 14A is a schematic cross-sectional view of the liquid discharge head 300 during a discharge operation and the application voltage applied to the piezoelectric element 332 at a time of the liquid discharge operation.

FIG. 14B is a schematic cross-sectional view of the liquid discharge head 300 during a non-discharge operation and the application voltage applied to the piezoelectric element 332 at a time of the non-discharge operation.

FIG. 14C is a schematic cross-sectional view of the liquid discharge head 300 illustrating the application voltage control of the piezoelectric element 332.

The liquid discharge head 300 according to the above-described embodiment uses the piezoelectric element 332 having a characteristic in which an entire length of the piezoelectric element 332 shortens in a longitudinal direction of the piezoelectric element 332 as the application voltage applied to the piezoelectric element 332 increases.

Conversely, the liquid discharge head 300 according to the Variation 1 uses the piezoelectric element 332 having a characteristic in which an entire length of the piezoelectric element 332 extends in the longitudinal direction of the piezoelectric element 332 as the application voltage applied to the piezoelectric element 332 increases.

As illustrated in FIG. 14A, a small voltage Vl (that is, a relatively small voltage) is applied to the piezoelectric element 332 as the application voltage so that the piezoelectric element 332 shortens in the longitudinal direction of the piezoelectric element 332 to move the needle valve 331 to the right side as illustrated in FIG. 14A. As a result, the nozzle 302 opens, and the ink 30 is discharged from the nozzle 302.

As illustrated in FIG. 14B, a voltage Vh larger than the above voltage Vl (that is, a relatively large voltage) is applied to the piezoelectric element 332 as the application voltage so that the piezoelectric element 332 expands in the longitudinal direction of the piezoelectric element 332 to move the needle valve 331 to the left side as illustrated in FIG. 14B. As a result, the nozzle 302 closes, and the ink 30 is prevented from discharging from the nozzle 302.

Therefore, the liquid discharge apparatus 1000 in the Variation 1 controls to decrease the application voltage applied to the piezoelectric element 332 according to an increase in the number of needle valves 331 to be simultaneously driven among the multiple needle valves 331 as illustrated in FIG. 14C.

As the number of needle valves 331 to be simultaneously driven increases, a correction amount ΔVl (that is, decrease amount) to be deducted to the reference drive voltage Vl is increased. The application voltage VL applied to the piezoelectric element 332 is controlled to be decreased as the number of needle valves 331 to be simultaneously driven increases. Thus, the piezoelectric element 332 is further displaced and a moving amount of the needle valve 331 increases.

As a moving amount of the needle valve 331 increases and a displacement of the needle valve 331 increases, the needle valve 331 retracts to a position farther from the nozzle 302 in the channel 312. Then, a decrease in a pressure loss occurs while the ink 30 flows from the supply port 311 to the nozzle 302. The pressure loss is caused by the needle valve 331 obstructing a liquid flow in the vicinity of the nozzle 302. Thus, the liquid discharge apparatus 1000 can prevent a decrease in the flow quantity and the discharge flow rate of the ink 30 discharged from each nozzle 302 (from one nozzle 302). As a result, the fluid resistance between the nozzle 302 and the needle valve 331 is reduced, and the discharge characteristics of the ink 30 are improved.

The liquid discharge apparatus 1000 according to the Variation 1 can accurately discharge a liquid even when the liquid is simultaneously discharged from the multiple nozzles 302 (liquid discharge ports) as the embodiments as described above.

Figure 15A:
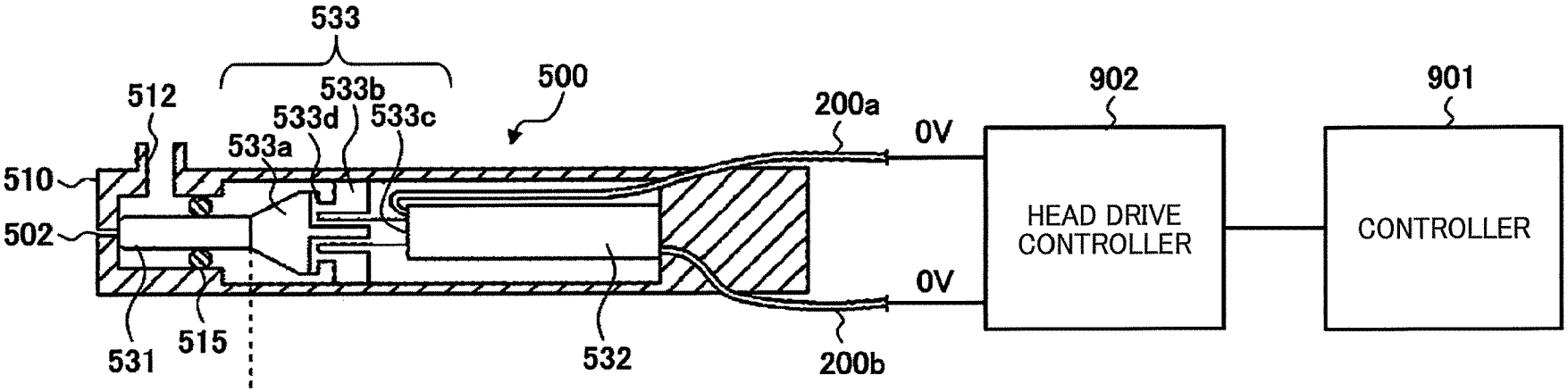
FIGS. 15A and 15B are cross-sectional views of the liquid discharge head according to a variation 2.
Figure 15B:
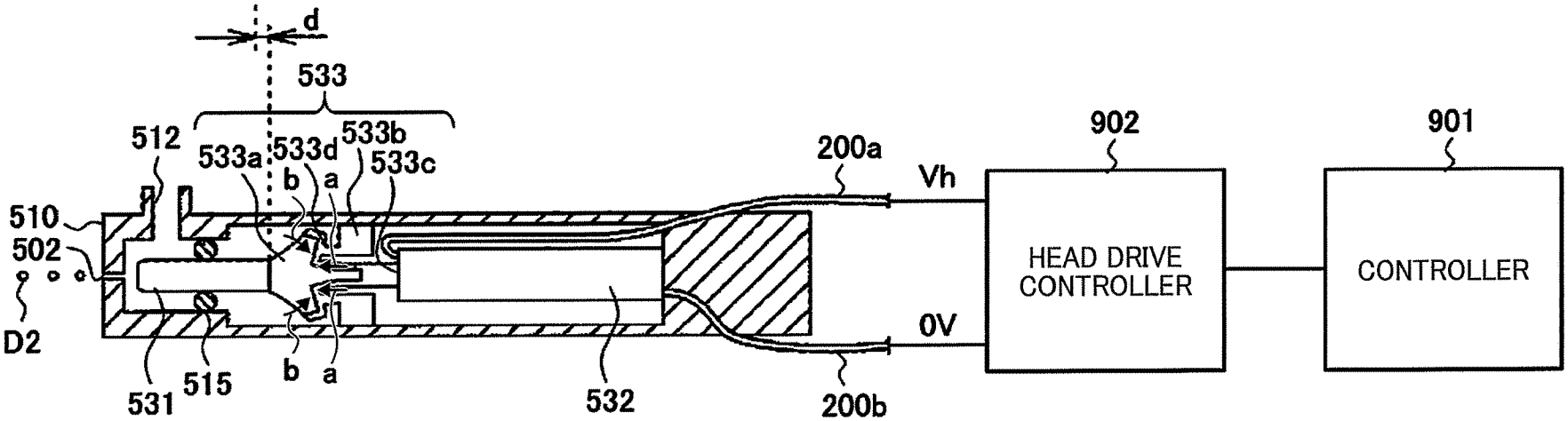

FIGS. 15A and 15B are cross-sectional views of the liquid discharge head 500 according to a variation 2.

FIG. 15A is a cross-sectional view of the liquid discharge head 500 according to a first embodiment in the variation 2 in a state in which the nozzle 502 (discharge port) is closed. The liquid discharge head 500 is a valve-type liquid discharge head.

FIG. 15B is a cross-sectional view of the liquid discharge head 500 according to the first embodiment in the variation 2 in a state in which the nozzle 502 (discharge port) is opened.

The liquid discharge head 500 illustrated in FIGS. 15A and 15B includes a hollow housing 510, a piezoelectric element 532, a needle valve 531, a reverse spring mechanism 533, a sealing 515, and a pair of lead wires 200*a* and 200*b*. The housing 510 includes a nozzle 502 to discharge liquid such as ink D2 at a leading end of the housing 510. The housing 510 further includes an injection port 512 in the vicinity of the nozzle 502. The injection port 512 is used to inject ink to the liquid discharge head 500.

The liquid discharge head 500 includes the piezoelectric element 532 inside the housing 510. The piezoelectric element 532 expands and contracts in response to an application of voltage from an exterior of the liquid discharge head 500. The piezoelectric element 332 expands in a left direction and contracts in a right direction in FIGS. 15A and 15B. The needle valve 531 opens and closes the nozzle 502. The reverse spring mechanism 533 is an example of a moving mechanism, and the reverse spring mechanism 533 is disposed between the needle valve 531 and the piezoelectric element 532.

The sealing 515 externally fitted to the needle valve 531 to prevent ink D2 from flowing to the piezoelectric element 532. The pair of lead wires 200*a* and 200*b* is coupled to electrodes of the piezoelectric element 532 and is used to apply voltage to the piezoelectric element 532.

Conversely, the liquid discharge head 500 according to the variation 2 uses the piezoelectric element 532 having a characteristic in which an entire length of the piezoelectric element 532 extends in the longitudinal direction of the piezoelectric element 532 as the application voltage applied to the piezoelectric element 532 increases as the piezoelectric element 332 used in the above-described Variation 1.

The housing 510 has a cylindrical body such as a cylinder or a square tube as a whole and has an enclosed space that is closed except the nozzle 502 and the injection port 512. The nozzle 502 is a small opening (hole) formed at a leading end of the housing 510. The ink D2 is discharged from the nozzle 502. The injection port 512 is formed on a side surface of the housing 510 near the nozzle 502. The pressurized liquid is continuously supplied into the injection port 512. The injection port 512 is coupled to an ink tank, and ink (or paint) is continuously supplied to the liquid discharge head 500 by a pressure unit such as a pump. The piezoelectric element 532 is formed using zirconia ceramics or the like.

The piezoelectric element 532 has an appropriate outer shape and thickness according to an amount of the ink D2 to be discharged from the nozzle 502. The piezoelectric element 532 is continuously applied with a voltage output from a head drive controller 902 controlled by the controller 901. The sealing 515 is, for example, a packing or an O-ring. The sealing 515 is externally fitted to the needle valve 531 so that the ink D2 is prevented from flowing from the injection port 512 to the piezoelectric element 532. A coating apparatus including the liquid discharge head 500 is configured by arranging multiple liquid discharge head 500 in parallel. The multiple liquid discharge head 500 respectively discharge inks D2 of different colors.

The reverse spring mechanism 533 is an elastic member formed by molding an appropriately deformable rubber, soft resin, thin metal plate, or the like. The reverse spring mechanism 533 includes a deformable portion 533*a*, a fixing portion 533*b*, and a guide portion 533*c*. The deformable portion 533*a* has a substantially trapezoidal cross-section. A top portion (left end in FIG. 15A) of the deformable portion 533*a* contact with a surface (right end surface of the needle valve 531 in FIG. 15A) of a base end of the needle valve 531. The fixing portion 533*b* is fixed to an inner surface of the housing 510. The guide portion 533*c* is coupled to an end surface of the piezoelectric element 532.

The top portion of the deformable portion 533*a* is coupled to the base end of the needle valve 531. A longer side (corresponding to a lower base of a trapezoid shape) of the trapezoidal deformable portion 533*a* serves as a bent side 533*d* coupled to the fixing portion 533*b*. In the reverse spring mechanism 533 having such a structure, when a predetermined voltage is applied to the piezoelectric element 532 via the head drive controller 902, the piezoelectric element 532 expands to move the guide portion 533*c* toward the nozzle 502 and presses a vicinity of a central portion of the bent side 533*d* of the deformable portion 533*a*. At the same time, a periphery of the bent side 533*d* is deformed to be pulled toward the piezoelectric element 532.

As a result, the top portion (corresponding to an upper base of the trapezoid) of the deformable portion 533*a* coupled to the needle valve 531 moves toward the piezoelectric element 532 as illustrated in FIG. 15B.

Thus, the needle valve 531 is pulled toward the piezoelectric element 532 by a distance "d" as illustrated in FIGS. 15A and 15B so that the nozzle 502 is opened. A distance between the top portion of the deformable portion 533*a* and the bend side 533*d*, and a length of the bent side 533*d* are appropriately adjusted. The top portion of the deformable portion 533*a* of the reverse spring mechanism 533 serves as a connection portion to be coupled to the needle valve 531.

Thus, a moving length (moving distance) of the needle valve 531 can be made longer than an expanding length of the piezoelectric element 532. That is, the reverse spring mechanism 533 can amplify a slight expansion of the piezoelectric element 532. For example, if a moving distance of the needle valve 531 is set to be twice as long as a moving distance of an end face of the piezoelectric element 532, the length of the piezoelectric element 532 can be reduced to about one half (½) of the conventional length of the piezoelectric element 532.

As described above, when the application voltage applied to the piezoelectric element 532 is in a 0V state (that is, a state in which a relatively small voltage is applied), the piezoelectric element 532 returns to its original shape, so that no external force is applied to the reverse spring mechanism 533, and no deformation occurs in the deformable portion 533*a* as illustrated in FIG. 15A.

On the other hand, when a voltage of +Vh is applied to the piezoelectric element 532 (that is, when a relatively large voltage is applied), the piezoelectric element 532 expands. Accordingly, the guide portion 533*c* of the reverse spring mechanism 533 moves in a direction toward the nozzle 502 (in an axial direction). Thus, the deformable portion 533*a* receives deformation in the axial direction and deforms as if the deformable portion 533*a* is crushed as illustrated in FIG. 15B.

[Operation of Valve-Type Liquid Discharge Head 500]

Next, an operation of the liquid discharge head 500 is described below. In a state in which no voltage is applied to the piezoelectric element 532, that is, when the application voltage is equal to 0V (that is, a relatively small voltage is applied), the deformable portion 533*a* of the reverse spring mechanism 533 is in an expanded state (normal state). The needle valve 531 is biased toward the nozzle 502 by an elastic force of the deformable portion 533*a*, and the nozzle 502 is closed by an end face of the needle valve 531 as illustrated in FIG. 15A. Therefore, the ink D2 is not discharged from the nozzle 502.

When a voltage (+Vh) is applied to the piezoelectric element 532 (that is, a relatively large voltage is applied), the leading end (left end in FIG. 15B) of the piezoelectric element 532 extends in an axial direction in FIG. 15B, and the guide portion 533*c* of the reverse spring mechanism 533 moves toward the nozzle 502 (in the axial direction). Along with the movement of the guide portion 533*c*, a portion in the vicinity of a central portion of the bent side 533*d* of the deformable portion 533*a* is pushed toward the nozzle 502 as indicated by an arrow "a" in FIG. 15B. At the same time, a periphery of the bent side 533*d* near an inner wall of the housing 510 retracts (bend) toward the piezoelectric element 532 in a direction as indicated by an arrow "b" in FIG. 15B.

The deformable portion 533*a* becomes in a compressed state, and a distance between the bent side 533*d* of the deformable portion 533*a* and the connection surface of the needle valve 531 is reduced. Thus, the needle valve 531 is pulled toward the piezoelectric element 532 by a distance "d" as illustrated in FIGS. 15A and 15B. As a result, a gap as illustrated in FIG. 15B is formed between a leading end surface of the needle valve 531 and the nozzle 502 so that the nozzle 502 is opened. Accordingly, the injection port 512 and the nozzle 502 communicate with each other, and the ink D2 is discharged from the nozzle 502.

Conversely, the liquid discharge head 500 according to the variation 2 illustrated in FIGS. 15A and 15B uses the piezoelectric element 532 having a characteristic in which an entire length of the piezoelectric element 532 extends in the longitudinal direction of the piezoelectric element 332 as the application voltage applied to the piezoelectric element 332 increases.

Further, a moving mechanism (reverse spring mechanism 533) is interposed between the piezoelectric element 532 and the needle valve 531, and a relatively large voltage is applied to the piezoelectric element 532 to move the needle valve 531 by the moving mechanism to open the nozzle 502 so that the ink D2 is discharged from the nozzle 502. Further, the application voltage applied to the piezoelectric element 532 is controlled to be relatively small so that a moving mechanism such as the reverse spring mechanism 533 closes the nozzle 302.

Similar to the above-described embodiment, that is, in the same manner as illustrated in FIGS. 7A and 7B and FIG. 8, the application voltage applied to the piezoelectric element 532 is controlled in accordance with the number of needle valves 531 to be simultaneously driven among the multiple needle valves 531.

Therefore, the liquid discharge apparatus 1000 in the second variation controls to increase the application voltage VH applied to the piezoelectric element 532 according to an increase in the number of needle valves 531 to be simultaneously driven among the multiple needle valves 531. As the number of needle valves 531 to be simultaneously driven increases, a correction amount ΔVh (that is, increase amount) to be added to the reference drive voltage Vh is increased. The application voltage VH applied to the piezoelectric element 532 is controlled to be increased as the number of needle valves 531 to be simultaneously driven increases.

Thus, the piezoelectric element 532 is further displaced and a moving amount of the needle valve 531 increases. As the moving amount of the needle valve 531 increases and a displacement of the needle valve 531 increases, the needle valve 331 retracts to a position farther from the nozzle 502 in the injection port 512. Then, a decrease in a pressure loss occurs while the ink D2 flows from a supply port to the nozzle 502. The pressure loss is caused by the needle valve 531 obstructing a liquid flow in the vicinity of the nozzle 502.

Thus, the liquid discharge apparatus 1000 can prevent a decrease in the flow quantity and the discharge flow rate of the ink D2 discharged from each nozzle 502 (from one nozzle 502). As a result, the fluid resistance between the nozzle 502 and the needle valve 531 is reduced, and the discharge characteristics of the ink D2 are improved.

The variation 2 has a configuration in which a moving mechanism is combined with the liquid discharge head 500 according to the Variation 1 that includes the piezoelectric element 532 having a characteristic in which an entire length of the piezoelectric element 532 extends in the longitudinal direction of the piezoelectric element 532 as the application voltage applied to the piezoelectric element 532 increases.

Conversely, the variation 2 may have a configuration in which a moving mechanism is combined with the liquid discharge head 500 that includes the piezoelectric element 532 having a characteristic in which an entire length of the piezoelectric element 532 shortens in the longitudinal direction of the piezoelectric element 532 as the application voltage applied to the piezoelectric element 532 increases.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The above-described embodiments are one of examples and, for example, the following Aspects 1 to 8 of the present disclosure can provide the following advantages.

[Aspect 1]

A liquid discharge apparatus 1000 according to Aspect 1 includes a liquid discharge head 300 (liquid discharger), a liquid supply unit, and various controllers (circuitry). The liquid discharge head 300 includes multiple nozzles 302 (liquid discharge ports) to discharge an ink 30 (liquid), the multiple needle valves 331 (valves) corresponding to the multiple nozzles 302, and the multiple piezoelectric elements 332 (drivers) to open and close the nozzles 302 by driving the multiple needle valves 331, respectively.

The liquid supply unit includes the compressor 108, the pipe 107 including the air regulators 106, the tanks 105, and tubes 311*a* to pressurize and supply the ink 30 to the liquid discharge heads 300.

The various controllers (circuitry) include the controller 901, the head drive controller 902, and the computer 903 to control the application voltage (for example, application voltage Vh) applied to the piezoelectric elements 332 according to a number of driven needle valves (driven valves) of the needle valves 331 (valves) to be simultaneously driven.

The liquid discharge head 500 illustrated in FIGS. 15A and 15ZB may be used instead of the liquid discharge head 300 illustrated in FIGS. 7A and 7B.

The liquid discharge apparatus 1000 according to Aspect 1 can accurately discharge a liquid even when the liquid is simultaneously discharged from the multiple nozzles 302 (liquid discharge ports).

[Aspect 2]

In the liquid discharge apparatus 1000 according to Aspect 2, the drive voltage includes a first drive voltage (0V), and a second drive voltage (Vh) larger than the first drive voltage to be applied to the liquid discharge heads 300 and 500.

The controller 901 (circuitry) is configured to: apply the second drive voltage (Vh) to the multiple piezoelectric elements 332 and 532 (drivers) corresponding to the driven needle valves 331 and 531 (driven valves) to open the multiple nozzles 302 corresponding to the driven needle valves 331 and 531 (driven valves) to discharge a liquid (ink 30 and D2) from each of the multiple nozzles 302 and 502 corresponding to the driven needle valves 331 and 531 (driven valves); and apply the first drive voltage to the multiple piezoelectric elements 332 and 532 (drivers) corresponding to undriven needle valves 331 and 531 (undriven valves) of the multiple needle valves 331 and 531 (valves) other than the driven needle valves 331 and 531 (driven valves) to close the multiple nozzles 302 and 502 corresponding to the undriven needle valves 331 and 531 (undriven valves).

The liquid discharge apparatus 1000 according to Aspect 2 can reliably stop a discharge of the ink 30 (liquid) from the nozzle 302 (liquid discharge port) even when a power supply is cut off due to an emergency or the like since the needle valve 331 (valves) closes the nozzle 302 (liquid discharge port).

[Aspect 3]

The liquid discharge apparatus 1000 according to Aspect 3 includes the controller 901 (circuitry) increases the second drive voltage (Vh) according to an increase in the number of driven needle valves 331 (driven valves).

[Aspect 4]

In the liquid discharge apparatus 1000 according to Aspect 4, the drive voltage includes a first drive voltage (0V), and a second drive voltage (Vh) smaller than the first drive voltage to be applied to the liquid discharge heads 300 and 500.

The controller 901 (circuitry) is configured to: apply the second drive voltage (Vh) to the multiple piezoelectric elements 332 and 532 (drivers) corresponding to the driven needle valves 331 and 531 (driven valves) to open the multiple nozzles 302 corresponding to the driven needle valves 331 and 531 (driven valves) to discharge a liquid (ink 30 and D2) from each of the multiple nozzles 302 and 502 corresponding to the driven needle valves 331 and 531 (driven valves); and apply the first drive voltage to the multiple piezoelectric elements 332 and 532 (drivers) corresponding to undriven needle valves 331 and 531 (undriven valves) of the multiple needle valves 331 and 531 (valves) other than the driven needle valves 331 and 531 (driven valves) to close the multiple nozzles 302 and 502 corresponding to the undriven needle valves 331 and 531 (undriven valves).

[Aspect 5]

The liquid discharge apparatus 1000 according to Aspect 5 includes the controller 901 (circuitry) decreases the second drive voltage (Vh) according to an increase in the number of driven needle valves 331 (driven valves).

[Aspect 6]

In the liquid discharge apparatus 1000 according to Aspect 6, the controller 901 (circuitry) increases a moving amount of the driven needle valves 331 (driven valves) according to an increase in the number of driven needle valves 331 (driven valves).

[Aspect 7]

The liquid discharge apparatus 1000 according to Aspect 7 includes a control table (drive waveform table 9026*d*) in which the number of driven needle valves 331 (driven valves) and a correction amount of the drive voltage to be applied to the multiple piezoelectric elements 332 (drivers) are associated with each other, and the controller 901

(circuitry) is configured to control the drive voltage according to the control table. The correction amount may be increased according to an increase in the number of driven needle valves 331 (driven valves) in the control table (drive waveform table 9026*d*).

The liquid discharge apparatus 1000 according to Aspect 7 can reduce a fluid resistance between the nozzle 302 (liquid discharge port) and the needle valve 331 (valve) and improve discharge characteristics of the liquid.

[Aspect 8]

The liquid discharge apparatus 1000 according to Aspect 8 includes the liquid discharge head 300 and 500 (liquid discharger) moves in one direction (X-direction), and the liquid discharge head 300 and 500 is inclined at an angle obtained from the resolution (dpi) of an image data to be given to the controller 901 (circuitry) in said one direction (X-direction) and a nozzle interval NP between the multiple nozzles 302 (liquid discharge ports) in another direction (Y-direction) orthogonal to said one direction (X-direction). The multiple nozzles 302 are liquidly connected in series.

The liquid discharge apparatus 1000 according to Aspect 8 can distributes drive timings of the multiple nozzles 302 (liquid discharge ports) and can reduce a number of the nozzles 302 (liquid discharge ports) to be simultaneously driven, that is a number of needle valves 331 (valves) to be simultaneously driven. The liquid discharge apparatus 1000 according to the first embodiment can accurately discharge a liquid even when the liquid is simultaneously discharged from the multiple nozzles 302 (liquid discharge ports).

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments such as the controller 901, the system controller 9011, the memory controller 9013, and the carriage controller 9015 may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

The invention claimed is:

1. A liquid discharge apparatus comprising:

a liquid discharge head configured to discharge a liquid; and a circuitry configured to drive the liquid discharge head, wherein the liquid discharge head includes:

multiple nozzles from each of which the liquid is dischargeable;

multiple valves configured to openably close the multiple nozzles, respectively; and multiple drivers configured to respectively drive the multiple valves, and the circuitry controls a voltage to be applied to the multiple drivers according to a number of driven valves of the multiple valves to be simultaneously driven.

2. The liquid discharge apparatus according to claim 1, wherein the voltage includes:

a first voltage; and a second voltage larger than the first voltage, and the circuitry is configured to:

apply the second voltage to the multiple drivers corresponding to the driven valves to open the multiple nozzles corresponding to the driven valves to discharge the liquid from each of the multiple nozzles corresponding to the driven valves; and apply the first voltage to the multiple drivers corresponding to undriven valves of the multiple valves other than the driven valves to close the multiple nozzles corresponding to the undriven valves.

3. The liquid discharge apparatus according to claim 2, wherein the circuitry increases the second voltage according to an increase in the number of driven valves.

4. The liquid discharge apparatus according to claim 1, wherein the voltage includes:

a first voltage; and a second voltage smaller than the first voltage, and the circuitry is configured to:

apply the second voltage to the multiple drivers corresponding to the driven valves to open the multiple nozzles corresponding to the driven valves to discharge the liquid from each of the multiple nozzles corresponding to the driven valves; and apply the first voltage to the multiple drivers corresponding to undriven valves of the multiple valves other than the driven valves to close the multiple nozzles corresponding to the undriven valves.

5. The liquid discharge apparatus according to claim 4, wherein the circuitry decreases the second voltage according to an increase in the number of driven valves.

6. The liquid discharge apparatus according to claim 1, wherein the circuitry increases a moving amount of the driven valves according to an increase in the number of driven valves.

7. The liquid discharge apparatus according to claim 1, further comprising:

a control table in which the number of driven valves and a correction amount of the voltage to be applied to the multiple drivers are associated with each other, wherein the circuitry is configured to control the voltage according to the control table.

8. The liquid discharge apparatus according to claim 7, wherein the correction amount in the control table is increased according to an increase in the number of driven valves.

9. The liquid discharge apparatus according to claim 1, wherein the liquid discharge head (300) moves in one direction, and the liquid discharge head is inclined at an angle obtained from a resolution of an image data to be given to the circuitry in said one direction and a nozzle interval between the multiple nozzles in another direction orthogonal to said one direction.

10. The liquid discharge apparatus according to claim 1, wherein the multiple nozzles are liquidly connected in series.

* * * * *